United States Patent [19]

Segger

[11] Patent Number: 4,784,075

[45] Date of Patent: Nov. 15, 1988

[54] WATERCRAFT WITH RIGHTING AID

[75] Inventor: Jürgen Segger, Hamburg, Fed. Rep. of Germany

[73] Assignee: Marion Kleist-Schörling, Hamburg, Fed. Rep. of Germany; a part interest

[21] Appl. No.: 74,273

[22] Filed: Jul. 16, 1987

[51] Int. Cl.[4] ..... B63B 3/14

[52] U.S. Cl. ..... 114/61; 114/39.1

[58] Field of Search ..... 114/39.1, 61, 90, 94, 114/102, 103, 121–126, 68

[56] References Cited

U.S. PATENT DOCUMENTS

| | | | |
|---|---|---|---|
| 3,865,061 | 2/1975 | Newman | 114/39 |
| 4,117,795 | 10/1978 | Ruiz | 114/39 |
| 4,344,377 | 8/1982 | Gram | 114/39 |
| 4,516,518 | 5/1985 | Cate | 114/39 |
| 4,651,666 | 3/1987 | Lake | 114/39 |

FOREIGN PATENT DOCUMENTS

| | | | |
|---|---|---|---|
| 3143317 | 5/1983 | Fed. Rep. of Germany | 114/39 |

*Primary Examiner*—Joseph F. Peters, Jr.
*Assistant Examiner*—Jesûs D. Sotelo
*Attorney, Agent, or Firm*—Becker & Becker, Inc.

[57] ABSTRACT

A watercraft, especially a sailboat having at least one hull and one mast. A righting aid is provided that is in the form of a pole-like righting element that has two ends, a first one of which is detachably connected to the watercraft in such a way that, essentially on a line at right angles to the plane of buoyancy, and essentially at the level of the center of gravity of the watercraft, the righting element is pivotable along at least one axis of freedom. The other end of the righting element is pivotable essentially orthogonally relative to the longitudinal axis of the watercraft for righting the latter when it has capsized.

13 Claims, 5 Drawing Sheets

WATERCRAFT WITH RIGHTING AID

BACKGROUND OF THE INVENTION

The present invention relates to a watercraft, especially a sailboat having at least one hull and one mast.

Sailboats that have no keel, and therefore have no dead ballast that is situated low in the boat, capsize when the righting moment is less than the moment that effects heeling-over of the sailboat. This capsizing behavior is shown, for example, by all sailing dinghies and, due to their specific construction, generally also by all multihull boats, such as catamarans, trimarans, etc.

With smaller sailing dinghies, one can manage to right a capsized sailboat by utilizing the leverage formed by the dropped center-board or leeboard of the sailing dinghy; in other words, the crew of the capsized sailboat tries to climb onto the leeboard so that the sailboat can right itself as a result of the force thereby exerted. With large sailboats of this type, the righting moment that can by formed by the leeboard and the crew of the sailboat is generally too small, because due to the mass of the sailboat and the sail that is in the water, the overturning, capsizing moment is too great. As a result, capsizing of larger sailboats of this type frequently leads to the complete loss of these boats, since the crew, for the aforementioned reasons, can no longer right the sailboat even if the storm that originally caused the capsizing has subsided.

It is an object of the present invention to provide a watercraft with a righting aid that permits the crew, without external aid, to again right a capsized watercraft.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
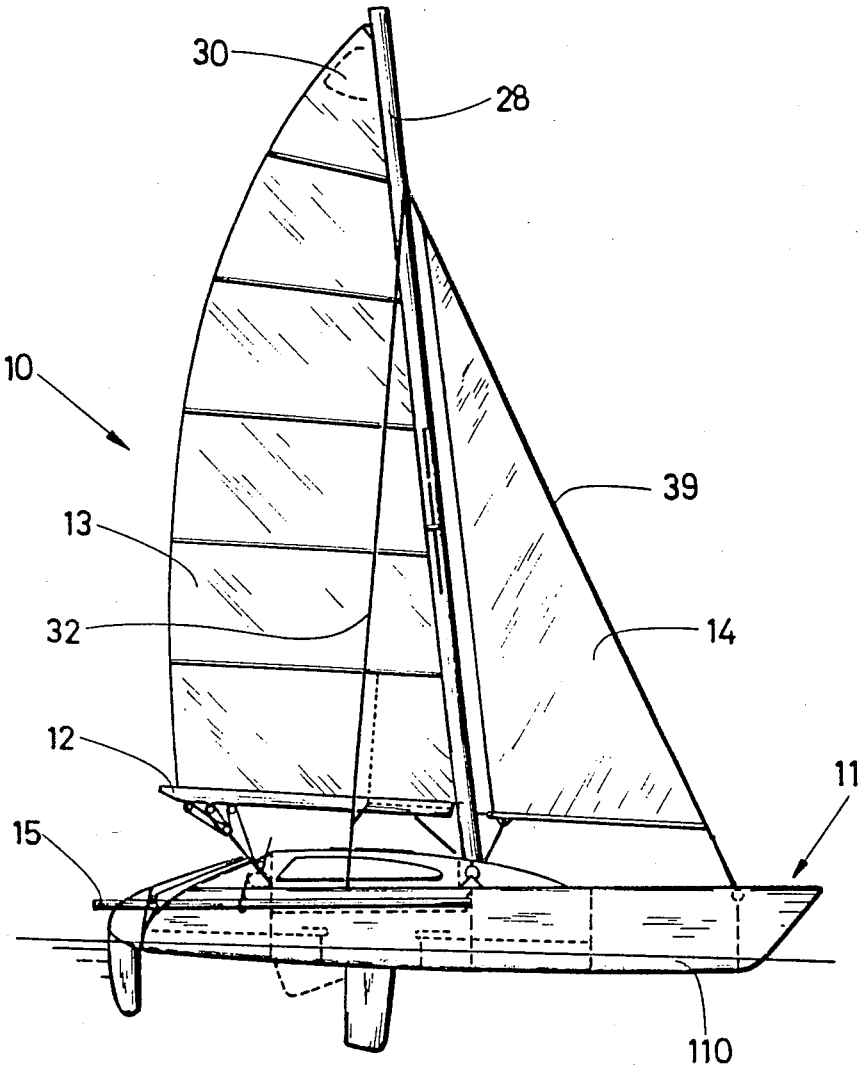
FIG. 1 is a side view of one exemplary embodiment of a watercraft with the inventive righting element in the rest position.

The watercraft of the present invention is characterized primarily in an arrangement including a righting aid in the form of a pole-like righting element that has two ends, a first one of which is detachably connected to the watercraft in such a way that, essentially on a line at right angles to the plane of buoyancy, and essentially at the level of the center of gravity of the watercraft, the righting element is pivotable along at least one axis of freedom; the other end of the righting element is pivotable essentially orthogonally relative to the longitudinal axis of the watercraft for righting the latter. This righting element can be formed by a boom and/or by a spinnaker boom.

The advantage of the inventively embodied watercraft is that the righting aid as such is always operational, and permits righting of the capsized watercraft even when all the crew is in the water and it is impossible to board the watercraft to install other righting aids due to wind conditions and waves. To right the watercraft, after the righting element has been pivoted essentially orthogonally relative to the longitudinal axis of the boat, it is merely necessary for the crew, which is in the water, to exert upon the free end of the righting element a suitable force, so that subsequently the capsized sailboat again rights itself in a straightforward manner.

Pursuant to an advantageous specific embodiment of the present invention, the righting element, in the inactive state, is disposed essentially parallel to the longitudinal axis of the boat. This is advantageously possible without separate structural features if, for example, the watercraft has a double hull (catamaran), whereby advantageously the righting element is then disposed essentially centrally between the double hulls. A righting element disposed in this fashion does not obstruct sailing maneuvers.

Pursuant to another advantageous embodiment of the inventive watercraft, the free end of the righting element is held by at least one longitudinally adjustable tackle or halyard, which is secured to the hull, in such a way that it cannot be shifted in the longitudinal direction. It should be noted that these halyards basically do not have to be attached to the free end of the righting element in the inactive state; rather, it is also conceivable to connect the halyards to the free end of the righting element only after the righting element has been pivoted into its righting position for righting the watercraft. However, the advantage of having the halyards always connected to the free end of the righting element is that it is then unnecessary to undertake a laborious attachment after the watercraft has capsized.

Where the watercraft have two hulls, it is advantageous to use two halyards, each of which is guided from a given one of the hulls to the free end of the righting element. Furthermore, the free end of the righting element, in the inactive state, can advantageously be held in its rest position by a detachable holder, which can then additionally prevent vertical movements of the righting element caused by swells, and hence will prevent someone from being struck by the righting element.

Especially with watercraft having large dimensions, it can be advantageous to secure the free ends of the righting element via one or more fixed-length stays to the hull in such a way that the righting element, with its free end in a pivoted state, being disposed essentially at right angles to the center of gravity, which is disposed in the longitudinal center of gravity axis. In this way, it is possible, in a pivoted out state after capsizing, to hold the free end of the righting element at the level of the center of gravity, at a predetermined level above the water that is determined by the length of the halyard, so that it is always possible to right the sailboat.

Pursuant to another advantageous specific embodiment of the inventive watercraft, the righting element can be embodied in such a way as to be telescopically extendible, thus insuring on the one hand that when it is not being used the righting element does not extend beyond the stern of the watercraft, where it would obstruct maneuverability, on the other hand however insuring that when needed such a length of the righting element could be withdrawn that the watercraft, for example for increasing the leverage, could also be righted by one person only.

In certain capsized positions of the watercraft, in the swung-out state the free end of the righting element could extend into the water. This could interfere with the righting process of the vehicle. Therefore, to prevent this, advantageously the free end region of the righting element is provided with buoyant material. This material is preferably formed by expanded plastic that is introduced into a tubular righting element. However, in principle any other buoyant material could also be used at the free end of the righting element.

In order after the watercraft, for example a sailboat, has capsized, on the one hand to prevent the capsized mast from extending too far into the water, and on the other hand to assure that the free end of the righting element does not project too far out of the water after the watercraft has capsized so that it is not uncomfortable or even impossible for the crew to reach it, an inflatable buoyant member is preferably disposed at the masthead or sailhead. Pursuant to a further advantageous specific embodiment, a buoyant member can additionally or alternatively also be provided in the sail; this buoyant member could also be inflatable.

Further specific features of the present invention will be described in detail subsequently.

DESCRIPTION OF PREFERRED EMBODIMENTS

Referring now to the drawings in detail, the illustrated embodiment shows, as a watercraft, a sailboat 10. As is known, the sailboat 10 comprises a body or hull 11, a mast 28, a boom 12, as well as a mainsail 13 and a foresail 14. In a manner known per se, the mast 28 is braced with two shrouds 32 and 33 to the side, and with a stay 39 to the front.

The present invention will be described with the aid of the sailboat 10, which pursuant to the drawings has a hull 11 that comprises a double hull 110, 111. Sailboats of this type are known as catamarans. The two double hulls 110, 111 are rigidly interconnected in a known manner by a number of transverse spars 35, 36, and 37. The center of spar 36 serves, for example, for mounting the mast 28.

As shown in particular in FIG. 3, one end 16 of a pole-like raising or righting element 15 is detachably connected via a joint or link 34 below the mast 28, i.e. essentially below the center of gravity 17 of the sailboat. The righting element 15 is pivotably secured about this link 34 with at least one axis of freedom, with the other free end 18 of the righting element 15 being essentially orthogonally pivotable to the longitudinal axis 19 of the boat (this axis 19 corresponds to the longitudinal axis of the system of boats having multiple hulls). It is expedient to embody the length 34 is such a way that the righting element 15 can be pivoted about all three possible axes of freedom.

The righting element 15 can be embodied as a single piece, for example in the form of a tube of metal, wood, plastic, or any combination of these materials. The righting element 15 could also be made of several pieces. Thus, to increase its overall length, and hence to increase the leverage for righting the sailboat 10, the righting element 15 can be made of several parts that can be fitted together. It is also possible to embody the righting element 15 in such a way that it can be extended telescopically.

Figure 7:
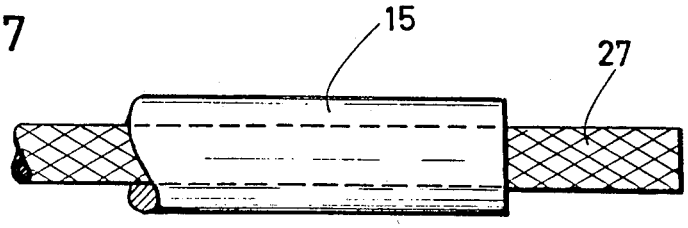
FIG. 7 is a view that shows the back, expanded plastic end of the righting element for forming a buoyant member.

As shown in FIG. 7, the region of the free end 18 of the righting element 15 is provided with a buoyant material 27, which can be plastic foam or an expanded plastic that is introduced into a tubular righting element 15.

Figure 2:
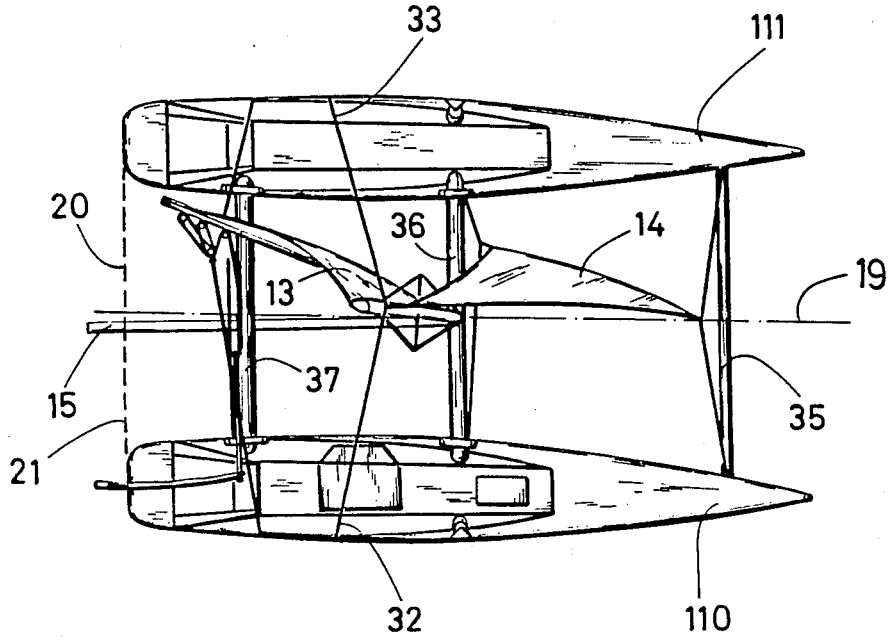
FIG. 2 is a plan view of the watercraft illustrated in FIG. 1 which has a double hull.
Figure 3:
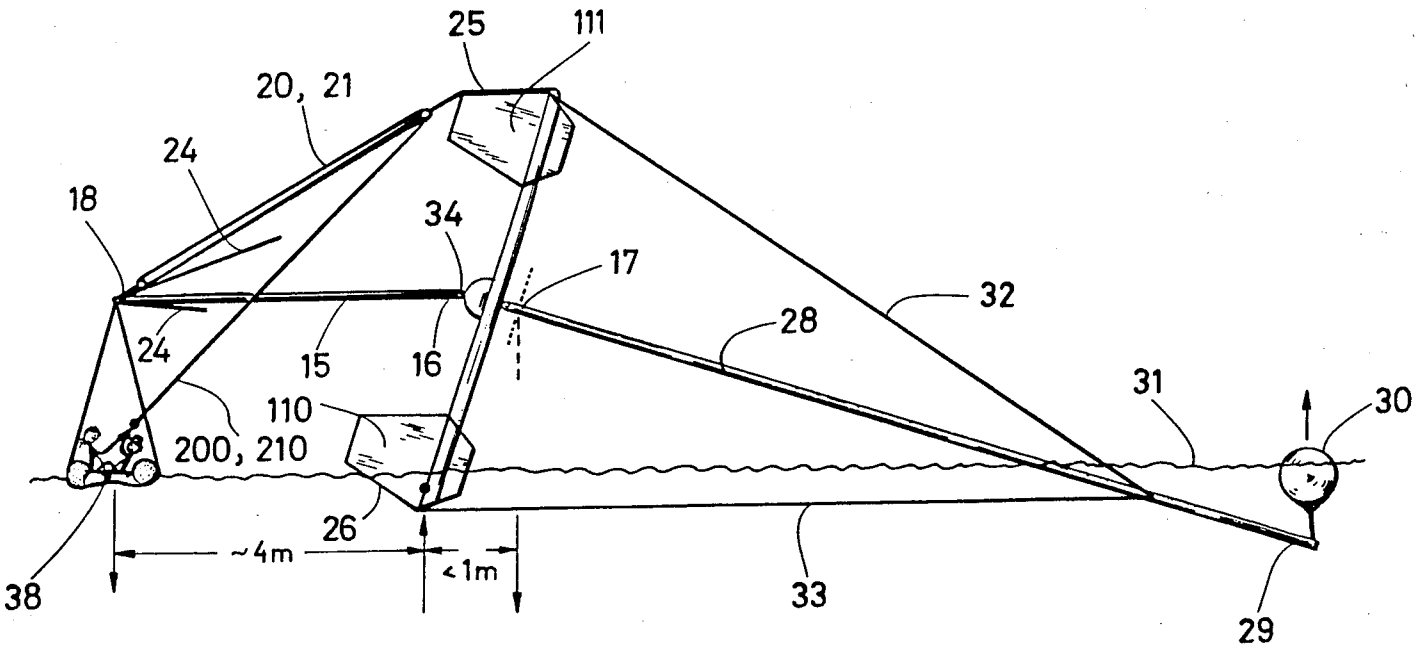
FIG. 3 is a view of a capsized watercraft showing a swung-out righting element and the crew, which is in a dinghy that is partially filled with water, and which rights the watercraft.

As shown in particular in FIGS. 2 and 3, the free end 18 of the righting element 15 is held by two tackles or halyards 20 and 21 that are embodied in such a way that their length can be adjusted. The halyards 20 and 21 are respectively secured to the two hulls 110 and 111. With these two halyards 20, 21, the righting element 15, in the inactive state, can be disposed essentially parallel to the longitudinal axis 19 of the boat; such an arrangement assures that the righting element 15, in the inactive state, does not disrupt the maneuverability of the sailboat 10 nor the handling by the crew. Furthermore, a detachable holder 23 can also be provided that additionally holds the free end 18 of the righting element 15, in the inactive state, in an inoperative position, so that the righting element does not bump against the transverse spars or other parts of the sailboat 10 when waves and/or wind are encountered.

Figure 4:
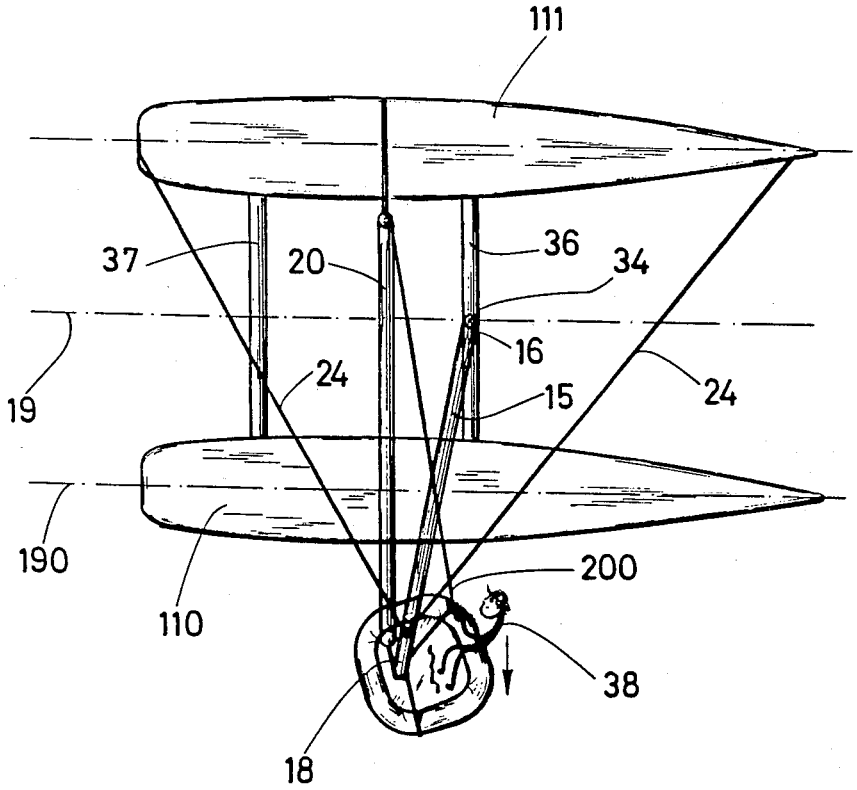
FIG. 4 is a view from above showing the capsized watercraft of FIG. 3.

As can be seen from FIGS. 3 and 4, the free end 18 of the righting element 15 can be respectively connected with the stern and bow regions via stays 24. The latter have a fixed length, so that the free end of the righting element 15, in the pivoted state, is disposed at essentially right angles to the center of gravity 17, which is disposed on the longitudinal center of gravity axis. As shown in FIGS. 3 and 4, the provision of such stays 24 as a horizontal lock guarantees that even when the righting element 15 is raised in the longitudinal direction of the sailboat 10, it cannot be shifted. In order to keep the righting element 15 from sinking too deep into the water, the free end 18 thereof is provided with buoyant material 27, so that even when the sailboat 10 has capsized, the free end 18 of the righting element 15 does not sink so deep into the water 31 that it can no longer be reached by the crew 38.

Figure 5:
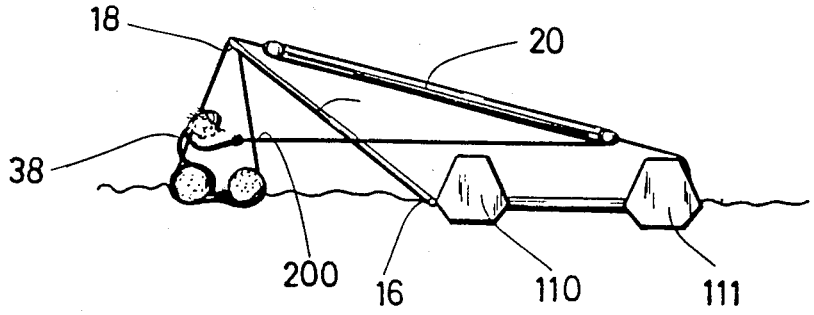
FIG. 5 is a view that shows a capsized watercraft with the righting element pivoted out, and with the crew, which is in a dinghy that is partially filled with water, and which rights the watercraft, with the securing of the fixed end of the righting element being affected in the region of the side of the boat.
Figure 6:
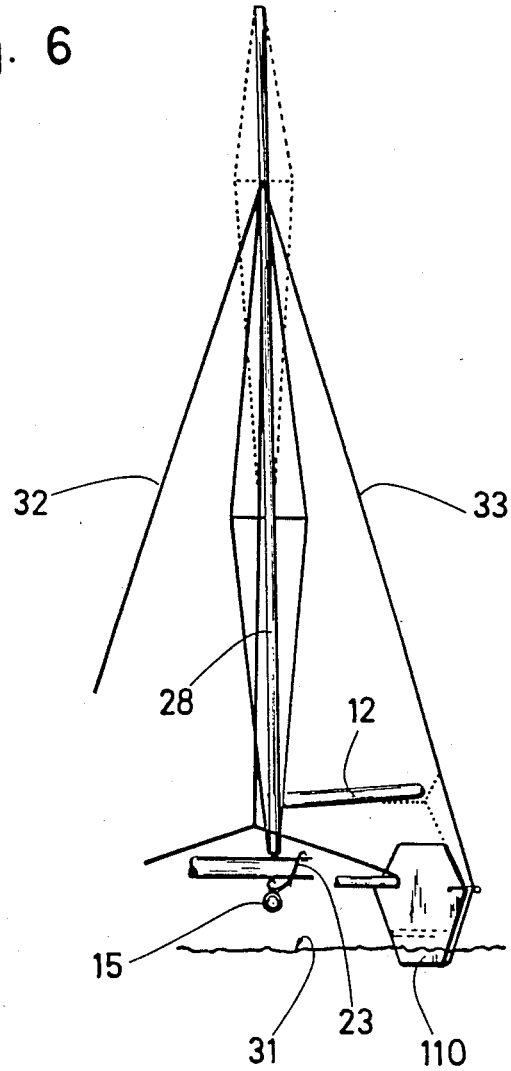
FIG. 6 is a partial view from behind of the sailboat of FIGS. 1 to 5.

As can be seen from FIGS. 3, 4, and 5, after the sailboat 10 has capsized, the righting element 15 is loosened from the holder 23, and similarly the halyards 20 and 21 are loosened, so that the righting elements 15 can be pivoted essentially orthogonally out of its inactive position into its active position. If the halyards 20, 21 have not yet been attached, this is accomplished at this time. The crew 38, which is in the water, can now grab hold of the free end 18 of the righting element 15 and secure themselves thereto, either directly, or via lifeboats or other lifesaving equipment, for example by means of suitable connecting elements, such as shackles, snap hooks and eyes, or the like. The crew 38 then graps hold of the loose ends 200 and 210 of the halyards 20 and 21, and begins the shortening process by pulling on the halyards. As a result, the sailboat 10 is gradually swung about and, when the condition of the unstable balance between the righting moment and the capsizing moment is exceeded, the sailboat automatically rights itself. The righting element 15 can subsequently be pivoted back in a similar manner, and can again be secured to the holder 23 as described, thereby replacing the righting element 15 in its inactive end position. The halyards 20 and 21 can then be shortened again so that they achieve the end position illustrated in FIG. 2.

To prevent the sailboat from sinking too deeply with the mast 28 into the water 31 after it has capsized, an inflatable buoyant member 30 can be provided on the masthead 29. Furthermore, buoyant members can also be disposed in the sails 13 and 14, for example in the mainhead; these buoyant members could also be inflatable.

With the aid of a rough calculation, it can be shown that a righting of the sailboat 10 is readily possible. Assuming, in the heeled-over state of FIG. 3, that the entire mass of the sailboat 10 is disposed one meter, in the direction of the masthead, ahead of the center of gravity of the sailboat, and assuming further that the mass is 800 kg., the righting element 15 has a length 4 m, and the crew 38 comprises three people (75 kg per person), there results a righting moment of +900 kg.m as compared to a heeling moment of −800 kg.m. The righting moment, formed by the righting element 15 as well as the crew 38, is therefore greater than the heeling moment, with the result that the sailboat 10 then rights itself.

In a sailboat having several hulls, the axis 190 about which the capsized sailboat is righted is essentially formed by the longitudinal axis of the boat, which extends through the hull 110, 111, as shown in particular in FIG. 4.

It should also be noted that the mast 28, the boom 12, or a spinnaker boom, not shown here, could also be used as the righting element 15.

The present invention is, of course, in no way restricted to the specific disclosure of the specification and drawings, but also encompasses any modifications within the scope of the appended claims.

What I claim is:

1. A watercraft having a center of gravity at a predetermined level and also having a longitudinal axis, comprising:

a righting aid in the form of a pole-like single righting element that has two ends, a first end of which is detachably secured to said watercraft in such a way that, essentially on a line at right angles to a plane of buoyancy, and essentially at the level of the center of gravity of said watercraft, said single righting element is pivotable along at least one axis of freedom; the other free end of said single righting element is pivotable essentially orthogonally relative to the longitudinal axis of said watercraft for righting the latter when the watercraft has capsized.

2. A watercraft according to claim 1, in which said righting element is formed by a boom.

3. A watercraft according to claim 1, in which said righting element has an inactive state in which it is disposed essentially parallel to said longitudinal axis of said watercraft.

4. A watercraft according to claim 3, which has a double hull, with said righting element being disposed essentially centrally between said hulls,

5. A watercraft according to claim 4, in which said free end of said righting element is held by at least one longitudinally adjustable halyard mounted on said hull.

6. A watercraft according to claim 4, which includes a releasable holder for holding said free end of said righting element in a rest position in said inactive state of the latter.

7. A watercraft according to claim 4, which includes at least one stay of fixed length for securing said free end of said righting element to said hull in such a way that a pivoted-out righting element, with its free end, is disposed essentially at right angles to said center of gravity, which is disposed on a longitudinal center of gravity axis.

8. A watercraft according to claim 1, in which said righting element is telescopically extendible.

9. A watercraft according to claim 1, in which at least the free end region of said righting element is provided with buoyant material.

10. A watercraft according to claim 9, in which said righting element is tubular, and said buoyant material is expanded plastic that has been introduced into said tubular righting element.

11. A watercraft according to claim 1, which is a sailboat having a mast with a masthead on which is disposed an inflatable buoyant member.

12. A watercraft according to claim 11, which includes sails, at least one of which is provided with buoyant means.

13. A watercraft according to claim 12, in which said buoyant means is inflatable

* * * * *

UNITED STATES PATENT AND TRADEMARK OFFICE

CERTIFICATE OF CORRECTION

PATENT NO. : 4,784,075

DATED : 15 November 1988

INVENTOR(S) : Jürgen Segger

It is certified that error appears in the above-identified patent and that said Letters Patent is hereby corrected as shown below:

On the title-abstract page, the following should be added:

[30] Foreign Application Priority Data

May 2, 1987 [EP] European Patent Application Ser. No. 87 106 398

Signed and Sealed this

Twenty-first Day of March, 1989

*Attest:*

DONALD J. QUIGG

*Attesting Officer*

*Commissioner of Patents and Trademarks*